US009757777B2

(12) United States Patent
Guglielmi et al.

(10) Patent No.: US 9,757,777 B2
(45) Date of Patent: Sep. 12, 2017

(54) CLEANING SYSTEMS AND METHODS

(71) Applicants: Paul Mark Guglielmi, Hilton, NY (US); Diana C. Petranek, Hilton, NY (US)

(72) Inventors: Paul Mark Guglielmi, Hilton, NY (US); Diana C. Petranek, Hilton, NY (US)

( * ) Notice: Subject to any disclaimer, the term of this patent is extended or adjusted under 35 U.S.C. 154(b) by 770 days.

(21) Appl. No.: 14/250,973

(22) Filed: Apr. 11, 2014

(65) Prior Publication Data

US 2014/0215748 A1 Aug. 7, 2014

Related U.S. Application Data

(63) Continuation-in-part of application No. 13/737,146, filed on Jan. 9, 2013, now Pat. No. 9,591,956.

(51) Int. Cl.

| | |
|---|---|
| ***A47L 5/18*** | (2006.01) |
| ***B08B 7/04*** | (2006.01) |
| ***B08B 5/02*** | (2006.01) |
| ***A47L 5/14*** | (2006.01) |
| ***B08B 15/04*** | (2006.01) |
| *B08B 5/04* | (2006.01) |

(52) U.S. Cl.

CPC *B08B 7/04* (2013.01); *A47L 5/14* (2013.01); *A47L 5/18* (2013.01); *B08B 5/02* (2013.01); *B08B 15/04* (2013.01); *B08B 5/04* (2013.01)

(58) Field of Classification Search

CPC ..... B08B 5/04; B08B 5/02; A47L 5/18; A47L 5/14

See application file for complete search history.

(56) References Cited

U.S. PATENT DOCUMENTS

| | | | | |
|---|---|---|---|---|
| 2,421,806 | A | 6/1947 | Perry | |
| 3,322,351 | A * | 5/1967 | Hackel | B01J 2/006 137/492.5 |
| 3,328,827 | A | 7/1967 | Lake | |
| 3,452,751 | A | 7/1969 | Austin | |
| 3,525,118 | A | 8/1970 | Viollet | |
| 3,830,405 | A * | 8/1974 | Jaeger | B67D 1/0021 222/129.3 |
| 3,918,676 | A | 11/1975 | Carson | |
| 4,055,870 | A | 11/1977 | Furutsutsumi | |
| 4,300,318 | A | 11/1981 | Brown | |
| 4,333,277 | A | 6/1982 | Tasedan | |
| 4,670,062 | A | 6/1987 | Lester | |
| 4,718,140 | A | 1/1988 | Johnson | |

(Continued)

FOREIGN PATENT DOCUMENTS

DE 29816397 U1 12/1998

OTHER PUBLICATIONS

European Patent Office (ISA/EP), European Search Report from European Patent Application No. 14737806.1, dated Sep. 28, 2016 (total 22 pages).

(Continued)

*Primary Examiner* — Michael Jennings

(74) *Attorney, Agent, or Firm* — Barclay Damon LLP

(57) ABSTRACT

A gas discharger connected to a source of pressurized gas comprises a gas channel that is opened to discharge the pressurized gas. A vacuum source can be separately or simultaneously operable with the gas discharger by using the pressurized gas or by using electrical power.

11 Claims, 10 Drawing Sheets

(56) References Cited

U.S. PATENT DOCUMENTS

| | | | | |
|---|---|---|---|---|
| 4,745,655 | A | 5/1988 | Johnson | |
| 5,107,632 | A | 4/1992 | Stern et al. | |
| 5,217,160 | A * | 6/1993 | Lopes | B05B 12/00 239/332 |
| 5,924,166 | A * | 7/1999 | Jones | A47L 5/14 15/330 |
| 6,367,119 | B1 * | 4/2002 | Jou | A47L 9/08 15/330 |
| 6,434,783 | B1 | 8/2002 | Arnold et al. | |
| 6,843,236 | B1 * | 1/2005 | Shetley | F02D 19/0605 123/525 |
| 7,243,559 | B2 * | 7/2007 | Dickson | G01M 15/102 73/863.01 |
| 8,153,001 | B2 * | 4/2012 | Peters | B01D 29/27 210/232 |
| 8,168,121 | B2 * | 5/2012 | Elkins | B09B 1/00 405/129.1 |
| 8,246,818 | B2 * | 8/2012 | Korzeniowski | B01D 24/008 137/140 |

OTHER PUBLICATIONS

USPTO (ISA/US), International Search Report from PCT Appl. No. PCT/US2014/010032 completed Oct. 6, 2014 (total 4 pages).

* cited by examiner

CLEANING SYSTEMS AND METHODS

CROSS REFERENCE TO RELATED APPLICATION

The present patent application is a continuation-in-part, and claims the benefit, of U.S. patent application Ser. No. 13/737,146, entitled "Air Gun System and Method", filed Jan. 9, 2013, the disclosure of which is incorporated herein by reference in its entirety.

FIELD OF THE INVENTION

The subject matter disclosed herein relates to systems and methods using compressed gas to clean objects.

BACKGROUND OF THE INVENTION

Various gas driven devices for cleaning industrial or electronic parts have been developed. Some of these devices use sand, or other forms of gritty material, to be dispersed in a gas discharge system to sand blast objects for cleaning purposes. Some equipment requires an overhanging tent to prevent the grit from contaminating surrounding areas, or must be used in an enclosed cabinet. Vacuum devices are commonly used to remove debris but cannot direct a stream of air toward a particular desired target for cleaning purposes. Other equipment that utilizes a gas blower or other gas discharge device may adequately clean objects but can also disperse the removed dirt and other contaminants, such as oil, into the surrounding environment. Such dispersion requires cleanup at a later time or may pollute the environment where the equipment is used and cause airborne contaminants to be inhaled. Many such systems are electrically powered and, if they are used intermittently, require frequent turn off/on cycles, which can be inconvenient. To avoid constant turning on and off, they may be kept powered on when not actively in use which can lead to a noisy work environment.

It would be useful to develop a gas discharge cleaning system that can be used to direct a stream of gas toward articles of manufacture to remove dirt, debris, and oils from machined parts and other objects while simultaneously vacuuming (suctioning) away the contaminants. This background discussion is merely provided for general information and is not intended to be used in determining the scope of the claimed subject matter.

SUMMARY OF THE INVENTION

A gas discharger may be used in combination with a vacuum source for cleaning objects. The gas discharger may be powered by pressurized gas that is received through a gas inlet and channeled to the gas discharger. The vacuum source may also be powered by the pressurized gas or by an electric motor and may be configured to be simultaneously operable or separately operable with the gas discharger. This provides a method for conveniently gas cleaning various objects. An advantage provided by such a system is that oil and debris can be forcefully blown off of manufactured parts, or other objects, and the oily mist or debris is simultaneously suctioned off into a waste container.

In one embodiment, a gas discharger comprises a gas channel configured to be opened and closed, a vacuum source, and a gas inlet configured to be connected to a source of pressurized gas. The gas discharger and the vacuum source are each configured to be in communication with the gas inlet and to be simultaneously operable by using the pressurized gas. A gas switch is connected between the vacuum source and the gas inlet to allow the pressurized gas to drive the vacuum source. A differential pressure sensor connected to the gas discharger and to the gas inlet electrically activates the gas switch in response to sensing that the gas channel in the gas discharger is opened.

In another embodiment, a gas discharger comprises a gas channel that is configured to be opened and closed, a vacuum source, and a gas inlet configured to be connected to a source of pressurized gas. The gas discharger and the vacuum source are each configured to be in communication with the gas inlet to be separately operable using the pressurized gas. A gas switch fluidly connects the vacuum source and the gas inlet when the gas switch is actuated, which activates the vacuum source using the pressurized gas.

In another embodiment, a gas discharger comprises a gas channel configured to be opened and closed, a gas inlet in fluid communication with the gas channel and configured to be connected to a source of pressurized gas, a vacuum source, and a differential pressure sensor connected to the gas discharger and to the gas inlet. The differential pressure sensor is configured to electrically activate the vacuum source in response to sensing that the gas channel in the gas discharger is opened.

In another embodiment, a gas discharger comprises a gas channel, the gas channel configured to be opened and closed, a vacuum tube, a gas inlet in fluid communication with the gas channel and configured to be connected to a source of pressurized gas, and a vacuum source configured to be electrically activated to generate a suction in the vacuum tube. A waste container is attached proximate a first end of the vacuum tube so that the suction draws air through a second end of the vacuum tube into the waste container.

In another embodiment, a first gas discharger comprises a first gas channel configured to be opened and closed, a gas inlet in fluid communication with the first gas channel and configured to be connected to a source of pressurized gas, and a vacuum tube comprising a vacuum source configured to generate a suction in the vacuum tube. A second gas discharger comprises a second gas channel configured to be opened and closed, and which is in fluid communication with the gas inlet. The second gas discharger is configured to discharge the pressurized gas into the vacuum tube. A waste container is attached proximate a second end of the vacuum tube such that the suction draws air through the first end of the vacuum tube into the waste container.

This brief description of the invention is intended only to provide a brief overview of subject matter disclosed herein according to one or more illustrative embodiments, and does not serve as a guide to interpreting the claims or to define or limit the scope of the invention, which is defined only by the appended claims.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

DETAILED DESCRIPTION OF THE INVENTION

Figure 1:
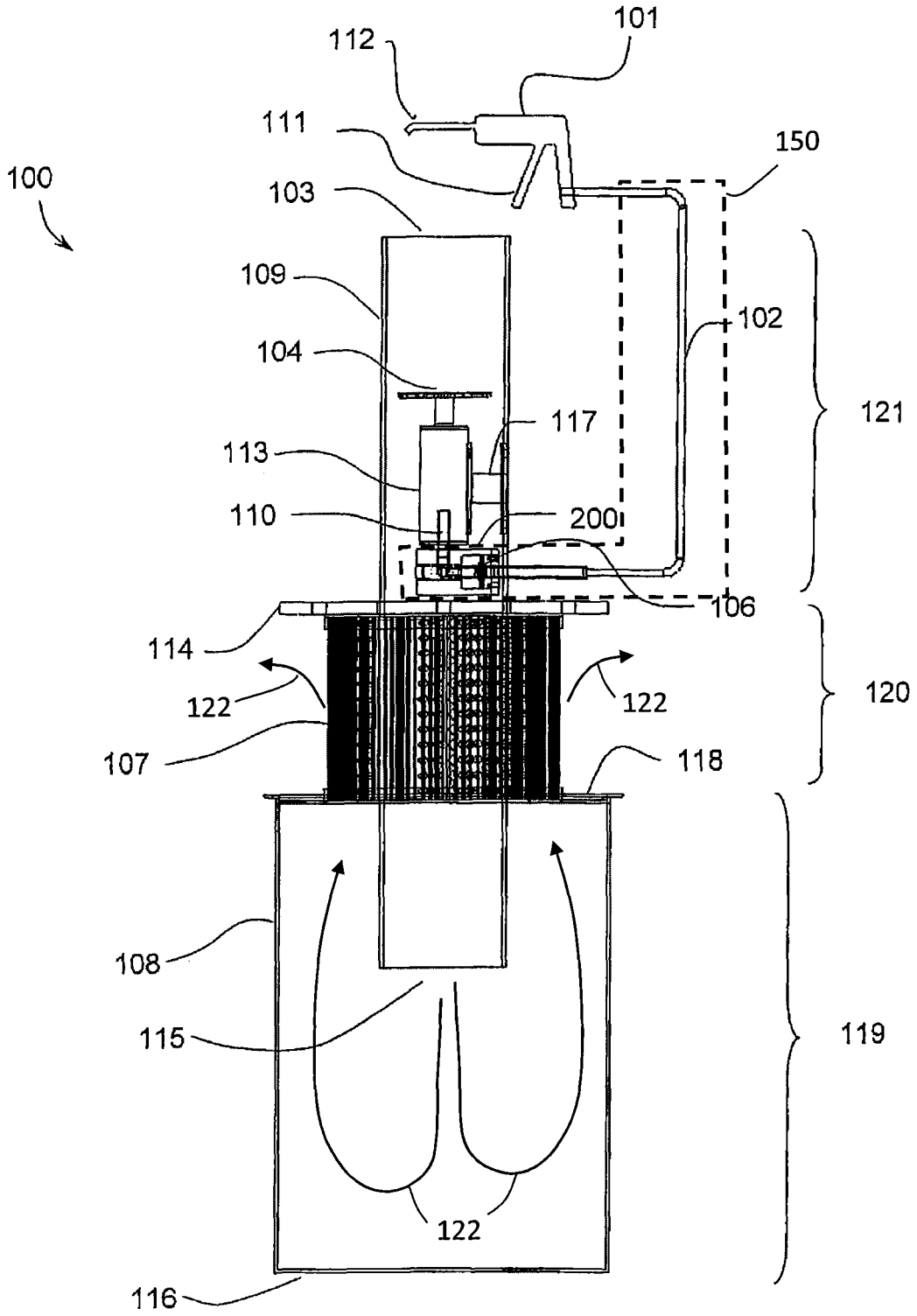
FIG. 1 is a perspective view of an exemplary gas cleaning system.

FIG. 1 illustrates one embodiment of a gas discharge system 100. Briefly, the gas discharge system 100 includes a gas discharger 101 having a nozzle 112 for ejecting gas and a trigger 111 for activating the gas discharger and the gas discharge system. Pressurized gas enters the gas discharger through gas discharger tube 102 which, in turn, is supplied through pressurized gas inlet 106 and is diverted to the gas discharger tube 102 by the valve assembly 200. Pressurized gas is also diverted to an air motor gas supply tube 110, by the valve assembly, which activates air motor 113. The air motor drives a fan 104 which suctions air through the vacuum tube 109 from its top opening 103 through the bottom opening 115 into a waste container 108. A gas filter 107 filters air that is exhausted from the vacuum tube bottom opening 115 and exits the waste container 108 through openings in the waste container cover 118. A more detailed description of the operation of the gas discharge system follows. Although compressed air is disclosed herein in several embodiments, other compressed gases may be used depending on operating requirements. The terms "compressed" or "pressurized" are used interchangeably herein; as are the terms "vacuum" and "suction".

In one embodiment, the gas discharge system 100 includes a gas discharger 101 which may be used to activate, or open, the system by manually squeezing the gas discharger trigger 111. Other means may be used to open a gas channel through the gas discharger 101, and the trigger 111 illustrated herein is but one example. The trigger is connected to a valve (not shown) within the gas discharger which opens a gas passage, or a gas channel, in the gas discharger (not shown), thereby activating the gas discharge system 100. Upon activation, the opened gas channel in the gas discharger allows pressurized gas to be discharged from the nozzle 112 of the gas discharger 101. The discharged gas stream is sufficient to blow off debris from various objects placed in the stream of the discharging gas. The gas passage in the gas discharger is connected to the nozzle and to a supply of pressurized air or other gas (not shown), such as a tank of compressed air, via a gas discharger tube 102 which may comprise a flexible tube such as a rubber or flexible plastic tube, a rigid tube such as a rigid plastic or metal tube, or a combination thereof. One embodiment of a gas discharger comprises a ¼" Blow Gun made by Prevost Corp., P/N 27202OSH, (prevostusa.com). The supply of pressurized air (or other gas) may comprise a tank of finite size containing compressed air that is connected to the gas discharge system 100 via a flexible or rigid tube such as the pressurized gas inlet 106. Typically, such as in a work shop, pressurized gas in the supply tank may be maintained at a pressure of about 40 psi to about 90 psi. It should be noted that the actual pressure may vary in a wide range and any mention herein of a range of pressures is not intended to limit embodiments included within the scope of the claimed subject matter.

When the trigger 111 is released, a release mechanism (not shown) which may comprise a spring type actuator, connected to the trigger and to the gas channel valve within the gas discharger 101, biases the trigger to return to its initial resting position which closes the valve, thereby shutting off the air passage within the gas discharger and deactivating the gas discharge system. As will be used herein, the term "open state" refers to a state of the gas discharge system wherein the valve in the gas discharger is open, in response to the trigger being squeezed, and pressurized gas flows through the gas discharge system from the pressurized gas supply; while the term "closed state" refers to a state of the gas discharge system wherein the valve in the gas discharger is closed, in response to the trigger being released, and blocks the air passage in the gas discharger, thereby shutting down the flow of pressurized gas through the gas discharge system, as will be described below. In one embodiment, squeezing and releasing the trigger causes the gas discharge system to alternate between the open (activated) and closed (deactivated) states, respectively.

When the gas discharge system is activated, the air motor 113 also receives pressurized gas via the air motor gas supply tube 110, which may comprise a flexible tube such as a rubber or flexible plastic tube, a rigid tube such as a rigid plastic or metal tube, or a combination thereof. When so activated, the air motor rotates a fan 104 connected to the air motor and causes air to be drawn downward through the vacuum tube 109 and creates suction at the vacuum tube top opening 103. Dirt, oil, dust, and various debris drawn by the suction at the vacuum tube opening travels downward through the vacuum tube past vacuum tube bottom opening 115 and into the waste container 108. Gas filter 107 filters air exiting the vacuum tube 109 and waste container 108 that is driven downward by the fan. A screen (e.g. 605, FIG. 6) may be fitted within the vacuum tube 109 for preventing cleaned objects from being accidentally sucked into the waste container while allowing smaller debris and/or oil mist to pass therethrough into the waste container.

The vacuum tube itself is made of a rigid plastic or metal, or a combination thereof. The air motor may be mounted to an inside surface (or wall) of the vacuum tube using an air motor mount 117, such as a suitable bracket, or other means, secured to the air motor and attached to the inside surface of the vacuum tube using, for example, screws. One embodiment of the air motor comprises a ¼" die grinder made by JET Tools (jettools.com), part No. JNS-7032. The gas filter is a common cylindrical shaped canister filter that is attached to the top of the waste container cover 118 along the filter's bottom rim and to a bottom surface of support plate 114 along the filter's top rim. Both attachments should be sufficiently tight so as to eliminate gaps and prevent an undue amount of dust or debris exiting the vacuum tube from bypassing the filter. Pressurized gas flows into the waste container 108 through the bottom opening 115 of the vacuum tube 109 and flows out of the waste container through slots or openings in the waste container cover 118. These slots or openings are located in the waste container cover between the opening for the vacuum tube 109 and the bottom rim of the gas filter 107. Thus, the pressurized gas exiting the waste container passes through the filter and any remaining dust or oil mist therein is trapped by the filter. Most of the suctioned debris, oil, dust, and other fragments fall into the waste container through the vacuum tube and remain there by force of gravity. The arrows 122 in FIG. 1 generally indicate this flow of pressurized gas into and out of the waste container.

The vacuum tube is attached to openings in the support plate 114 and the waste container cover 118 along an outer surface of the vacuum tube such that the vacuum tube extends into the waste container 108 beyond the waste container cover 118 for a short distance. The outer diameter of the vacuum tube matches the size of the openings in the support plate and the waste container cover through which it passes for easy attachment thereto, such as by brackets, press fit, plastic weld, or adhesives. In one embodiment, the vacuum tube and the waste container cover may be made from one piece of molded plastic, or the vacuum tube and the support plate may be made from one piece of molded plastic. These two attachment locations (support plate and waste container cover) along the outer surface of the vacuum tube serve to secure the vacuum tube in a vertical orientation when the bottom 116 of the waste container is placed on a floor, for example. Although the bottom of the vacuum tube is shown having a circular opening, the bottom of the vacuum tube may be cut at an angle. The portion of the gas discharge system 100 within the dashed line box 150 includes a portion of the gas discharge system 100 that may be referred to herein as an exchangeable portion 150 of the gas discharge system 100. This portion 150 of the system may be replaced by another exchangeable portion of the systems described herein to construct various embodiments of gas discharge systems. The portion of gas discharge system 100 within the exchangeable portion 150 includes at least a portion of the gas discharge tube 102, at least a portion of the air motor gas supply tube 110, the valve assembly 100, and at least a portion of the pressurized gas inlet 106.

Figure 2:
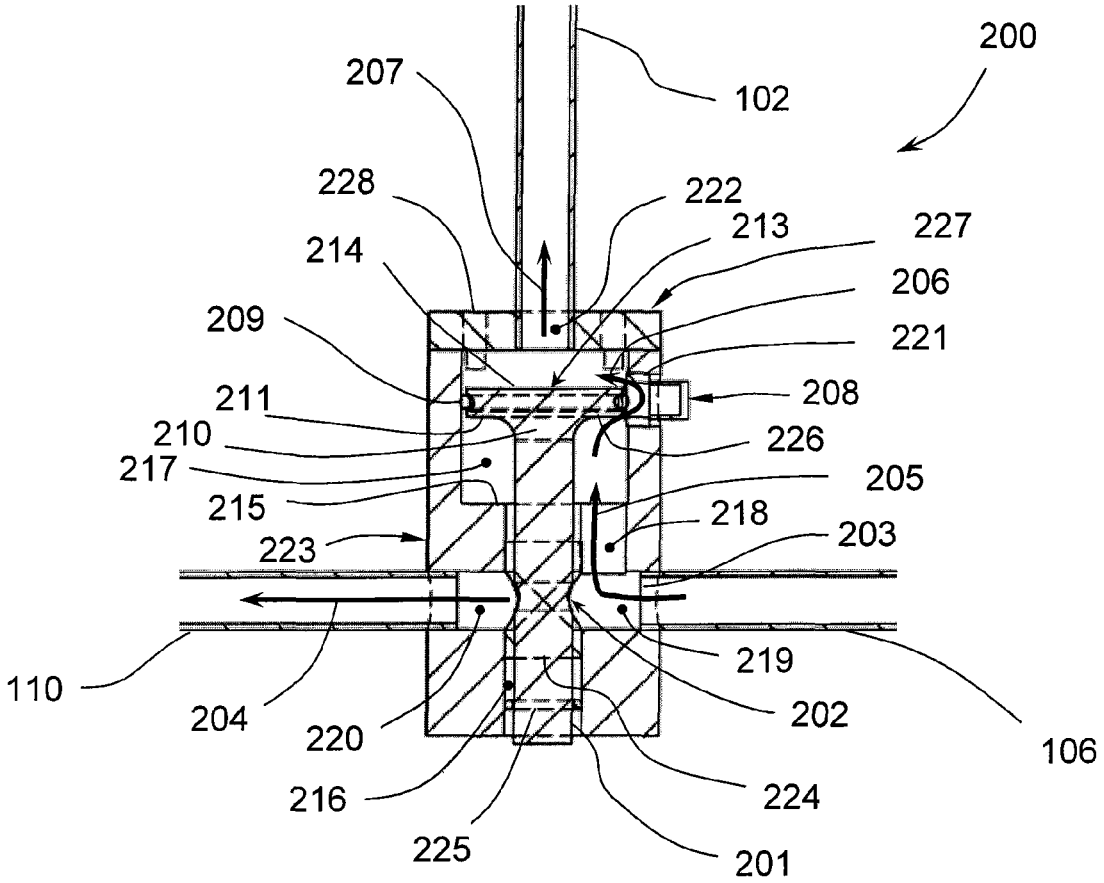
FIG. 2 is a cross-section of the valve assembly in an open state.
Figure 3:
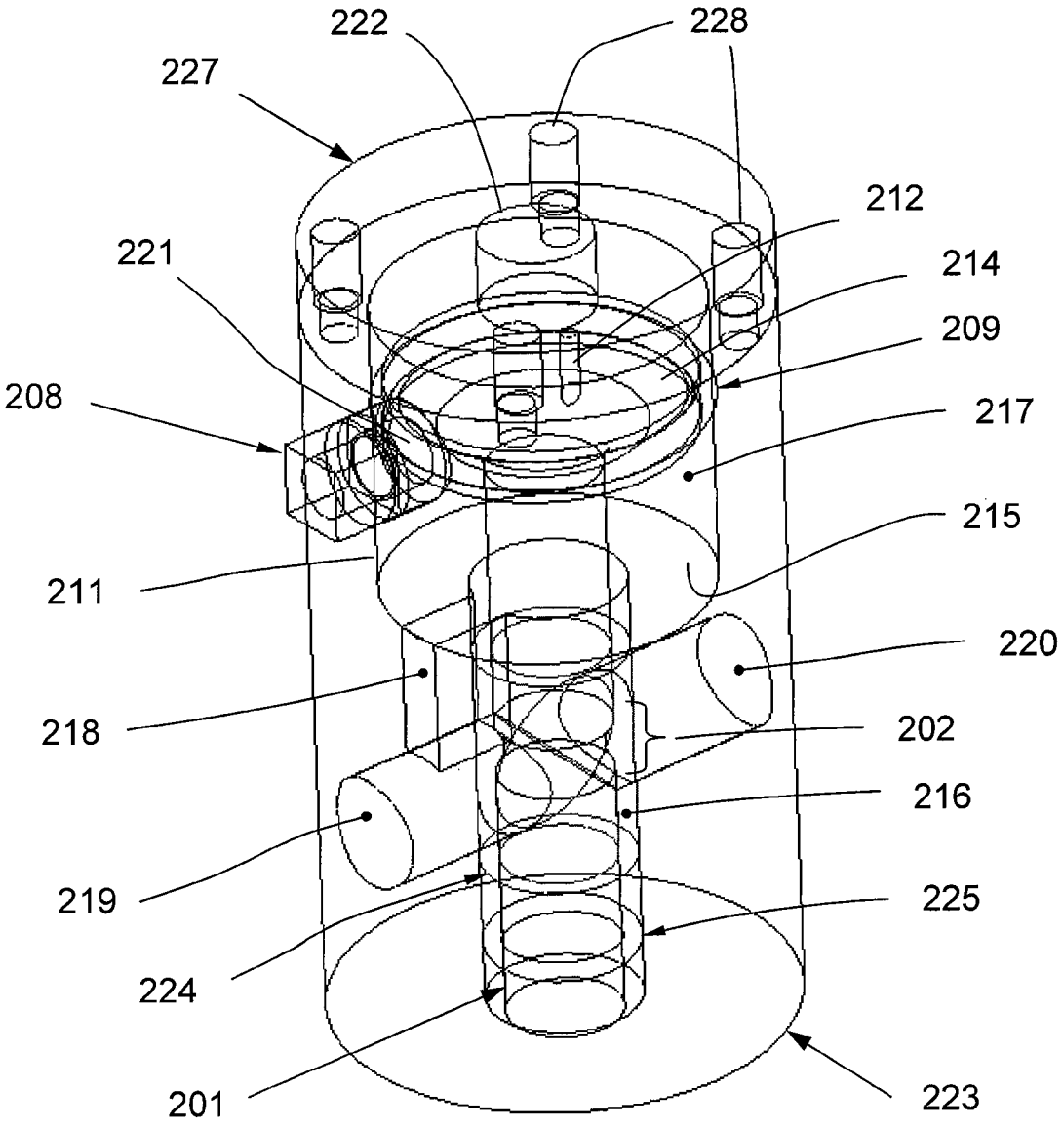
FIG. 3 is a transparent perspective view of the valve assembly.

With reference to FIG. 2 and FIG. 3 there is illustrated a valve assembly 200 in two views. FIG. 2 illustrates a cross section of the valve assembly while FIG. 3 illustrates a perspective transparent view of the valve assembly which may be helpful in visualizing the relative spatial relationships of the features of the valve assembly as described herein. The following detailed description can be referenced entirely in relationship to FIG. 2 alone. Thus, although not all the features of FIG. 2 are visible in FIG. 3, FIG. 3 can be referenced in the following detailed description as an aid to clarifying the shapes and spatial configurations of the various parts of the valve assembly.

The valve assembly 200 is connected to the pressurized gas inlet 106 via the pressurized gas opening 219, to the air motor gas supply tube via the air motor outlet 220, and to the gas discharger tube 102 via gas discharger outlet 222. By operation of the valve assembly, when the gas discharge system 100 is in the open state, pressurized gas enters the gas discharge system via the pressurized gas inlet 106 and travels through the valve assembly to both the air motor gas supply tube 110 and to the gas discharger tube 102. Thus, the pressurized gas traveling to the air motor through the air motor gas supply tube is also activated by squeezing the trigger 111. The valve assembly 200 comprises a cylinder shaped valve body 223, as seen from its exterior (FIG. 1), having three openings as follows: the pressurized gas opening 219, the air motor outlet 220, and the piston rod guide tube 216, all of which are sealed either to their corresponding gas tubes, or around the piston rod, with respect to the external atmosphere, in a gas tight fashion. A fourth opening—the gas discharger outlet 222—passes through the valve cap 227, which is secured to the valve body in a gas tight fashion as described below, and the gas discharger outlet 222 itself is also sealed in a gas tight fashion to the gas discharger tube 102.

The pressurized gas opening 219 is connected to receive pressurized gas from the pressurized gas inlet 106, wherein the pressurized gas inlet extends into the pressurized gas opening of the valve body, as is illustrated by the terminal end 203 of the pressurized gas inlet 106 within the pressurized gas opening 219, and is attached thereto by, for example, threading the opening and the pressurized gas outlet and screwing them together. Similarly, the air motor outlet 220 is connected to the air motor gas supply tube 110, wherein the air motor gas supply tube extends into the air motor outlet of the valve body, and is attached thereto by, for example, a similar threaded connection. Similarly, the gas discharger outlet 222 in the valve cap 227 is connected to the gas discharger tube 102, wherein the gas discharger tube extends into the gas discharger outlet of the valve cap 227, and is attached thereto by, for example, a similar threaded connection. The cylinder shaped valve body encloses a piston mechanism, as described below.

The valve assembly of FIG. 2 is illustrated in an open state of the gas discharge system, wherein pressurized gas enters the valve assembly via the pressurized gas opening. The pressurized gas travels through the pressurized gas opening in the valve body, travels upward, as seen in FIG. 2, indicated by arrow 205, through the valve interior gas channel 218 formed in the valve body and extending from the pressurized gas opening to the piston chamber 217. The pressurized gas then travels around piston 213 through a plug depression 221 on the inside surface of the piston chamber, as indicated by arrow 206, then through the gas discharger outlet 222 and into the gas discharger tube 102, as indicated by arrow 207, to the gas discharger.

Pressurized gas that powers the air motor travels through the pressurized gas inlet 106 from the supply of pressurized gas, enters the valve body through the pressurized gas opening, travels through an opening in the bushing 224 facing the pressurized gas opening, and around the piston rod bevel 202, through another opening in the bushing facing the air motor outlet, and through the air motor outlet and into the air motor gas supply tube, as indicated by arrow 204, to the air motor. The openings in the bushing substantially match the diameter of the pressurized gas inlet and the air motor outlet. Thus, a vertical distance, from the perspective of FIG. 2, from the piston 213 to the piston rod bevel 202 substantially matches a vertical distance between the plug depression 221 and the pressurized gas opening 219 so that the pressurized gas pathways indicated by arrows 204 and 206 are opened simultaneously.

Several other features of the valve assembly will now be described followed by further operational details of the valve assembly. The piston assembly comprises the piston, which has a circular contour as viewed from the top, matching the circular contour of the piston chamber (FIG. 5), and narrows to form a piston neck 210 and a piston rod portion 201. The piston assembly is typically formed as a single integrated structure such as by metal casting or it may be made of a suitable plastic. The piston assembly may also be formed in parts and attached together. For example, the piston rod may be screwed into the piston bottom surface. The piston includes an annular recess 211 around its perimeter wherein o-ring 209 is disposed. The piston assembly travels up and down, as viewed in FIG. 2, which movement is limited in the upward direction by the top face 214 of the piston traveling in the piston chamber and contacting the bottom of piston cap 227. Its downward movement is limited by the bottom face 226 of the piston contacting the bottom face 215 of the piston chamber. The o-ring in the perimeter of the piston contacts the interior surface of the piston chamber in a substantially gas tight fashion with or without movement by the piston therethrough. The piston rod travels through the piston rod guide tube 216 in an upward and downward fashion. The piston rod guide tube comprises a recess on its interior surface for receiving o-ring 225 which provides a gas tight seal against the piston rod with or without movement by the piston rod therethrough. The two o-rings, in the piston and in the piston rod guide tube, are typically made of rubber and are greased to ensure a gas tight fit and for lubricating movement of the piston assembly.

The plug depression is formed by an opening through the valve body being closed off by plug 208 and leaving a depression on the inside surface of the piston chamber sufficiently deep to provide an air gap to allow air to bypass the piston when the piston is positioned at the plug depression, as shown in FIG. 2. The plug 208 may be threaded, along with the plug opening, and screwed part of the way into the opening so as to form a depression on the inside surface of the piston chamber. The plug may also be permanently affixed, such as by welding, part of the way into the plug opening. In either case, the plug seals the opening in a gas tight fashion. The piston cap comprises four screw holes 228 through which four screws secure the piston cap to the valve body. A gasket or other sealant may be used between the valve cap and the valve body to ensure a gas tight seal. The piston comprises a bleed hole 212 that provides an air passage between the region in the piston chamber above the piston and the region below the piston. Thus, air pressure in the valve assembly tends to equalize on the top and bottom sides of the piston due to the free passage of air through the bleed hole.

As described above, the valve assembly of FIG. 2 is illustrated in an open state which allows pressurized gas to travel through the valve assembly to both the gas discharger and the air motor. While in the open state the piston assembly remains in the position as illustrated in FIG. 2 at least partially due to the force of the air traveling around the piston rod bevel from the pressurized gas inlet to the air motor outlet. As the piston rod moves upward or downward, from its position as shown in FIG. 2, the air gap provided by the piston rod bevel decreases and the movement of the pressurized gas through the shrinking air gap tends to resist this movement when the system is in the open state, and so aids in stabilizing the piston assembly in a position wherein the air gap provided by the piston rod bevel is at a maximum size. If the piston rod bevel travels beyond the openings in the bushing (when the system is in the closed state, as shown in FIG. 4), the air passage from the pressurized gas inlet to the air motor outlet becomes closed off by the larger diameter portion of the piston rod being positioned at the openings in the bushing.

Figure 4:
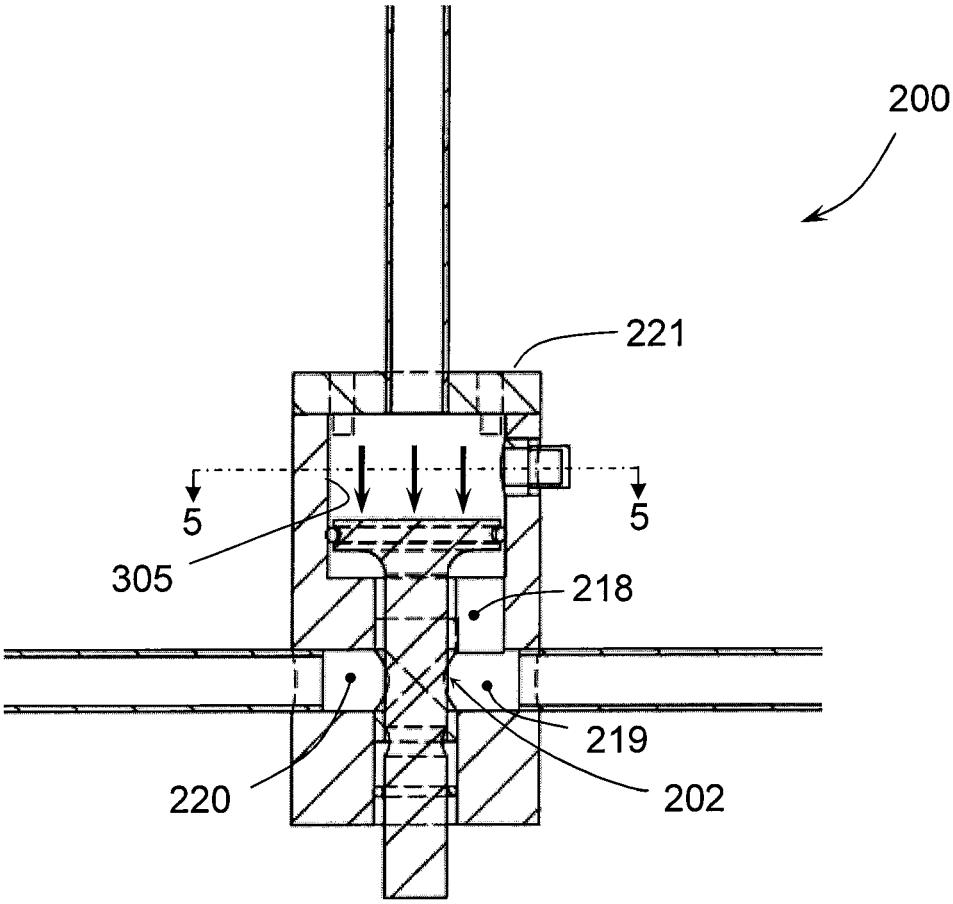
FIG. 4 is a cross-section of the valve assembly in a closed state.

When the trigger is manually released the system transitions from the open state, as shown in FIG. 2, to the closed state, as shown in FIG. 4, wherein the pressurized gas stops flowing through the valve assembly, due to the closed air passage in the gas discharger. As pressurized gas stops flowing through the gas discharger outlet, a rapid build-up of air pressure occurs within the valve assembly until it reaches a static air pressure level equal to the supply pressure of the air tank connected to the pressurized gas inlet. In this state, the static air pressure in the piston chamber is equalized above and below the piston due to the bleed hole 212 in the piston, as described above. Because the area of the entire top surface of the piston is subject to this static air pressure, which creates a downward force against the piston top surface, while a smaller area of the piston bottom surface is exposed to this same level of static air pressure, which creates a smaller upward force against the piston bottom surface, the downward force prevails and the piston assembly moves down. One reason that the piston bottom surface exposes a smaller area to the static air pressure is that part of the piston bottom surface comprises the piston neck, connected to the piston rod, and the bottom of the piston rod is not subject to this static air pressure because it protrudes from the valve body. Thus, the total downward force applied to the piston top surface, due to the pressurized gas, is greater than the upward force applied to the piston bottom surface from the pressurized gas.

With reference to FIG. 4, the valve assembly is illustrated in a closed state of the gas discharge system. Several elements of the valve assembly are not enumerated in FIG. 4 for purposes of clarity in the figure. The piston has been pushed downward, as explained above, to a position wherein the o-ring around the perimeter of the piston is circumferentially sealed in a gas tight fashion against the inside surface 305 of the piston chamber, and so the air travel pathway around the piston via the plug depression (206 of FIG. 2) is no longer accessible. The piston rod bevel has also been pushed downward and no longer provides an air gap between the pressurized gas opening and the air motor outlet which is the gas pathway used by the pressurized gas to power the air motor. Thus, the gas discharger and the air motor are de-activated and the gas discharge system remains in a closed state, as illustrated in FIG. 4, so long as the trigger remains in its released position.

When the trigger is again squeezed the valve in the air passage of the gas discharger opens and releases the air pressure built up in the piston chamber in the region above the piston, and causes the gas discharge system to transition from the closed state to the open state. This will rapidly reduce the prevailing downward force of the air pressure against the piston top surface, and so the pressurized gas entering the piston chamber in the region below the piston through the pressurized gas opening 219 and through the valve interior gas channel 218 pushes the piston upward to the open state of the gas discharge system as shown in FIG. 2. This stabilizes the piston assembly in that position so long as the trigger remains squeezed and the pressurized gas supply provides pressurized gas. The more rapid reduction of the downward force of the air pressure against the piston top surface, as compared to the upward force of the air pressure against the piston bottom surface, occurs because the rate of the air moving out of the piston chamber region above the piston and through the gas discharger outlet is greater than the rate of the air traveling through the bleed hole from the piston chamber region below the piston. The only exit path for pressurized gas in the piston chamber region below the piston is through the bleed hole when the gas discharge system is transitioning from the closed state to the open state and before the piston reaches the plug depression during its upward movement.

With reference again to FIG. 1, exemplary dimensions of the gas discharge system are as follows. The waste container comprises a height 119 of approximately one and one-half feet; the gas filter comprises a height 120 of approximately half of one foot; and the vacuum tube comprises a height 121 of approximately one foot above the gas filter, resulting in a gas discharge system of approximately three feet in height. It should be noted that embodiments of the gas discharge system may vary in a wide range of sizes and shapes, and any mention herein of a lengths, widths, or other dimensions or shapes are exemplary only, and are not intended to limit embodiments included within the scope of the claimed subject matter.

Figure 5:
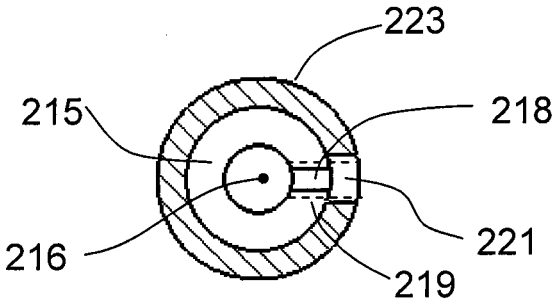
FIG. 5 is a top view of the valve body.

With reference to FIG. 5, there is illustrated a top view of the valve body 223 shown in cross section 5-5 as defined in FIG. 4. The piston assembly is removed in this figure as well as the plug for purposes of clarity in the figure. As shown, the pressurized gas opening 219, the valve's interior gas channel 218, and the plug opening 221 are aligned in a vertical plane (from the perspective of FIG. 2). The pressurized gas opening 219 enters the valve body 223 and is in fluid communication with the valve's interior gas channel 218, which is slightly narrower than the pressurized gas opening and extends upward to the piston chamber bottom surface 215 and is in fluid communication with the piston chamber 217. The piston rod guide tube 216, the piston chamber, and the exterior of the valve body are shown in a relatively concentric formation.

Figure 6:
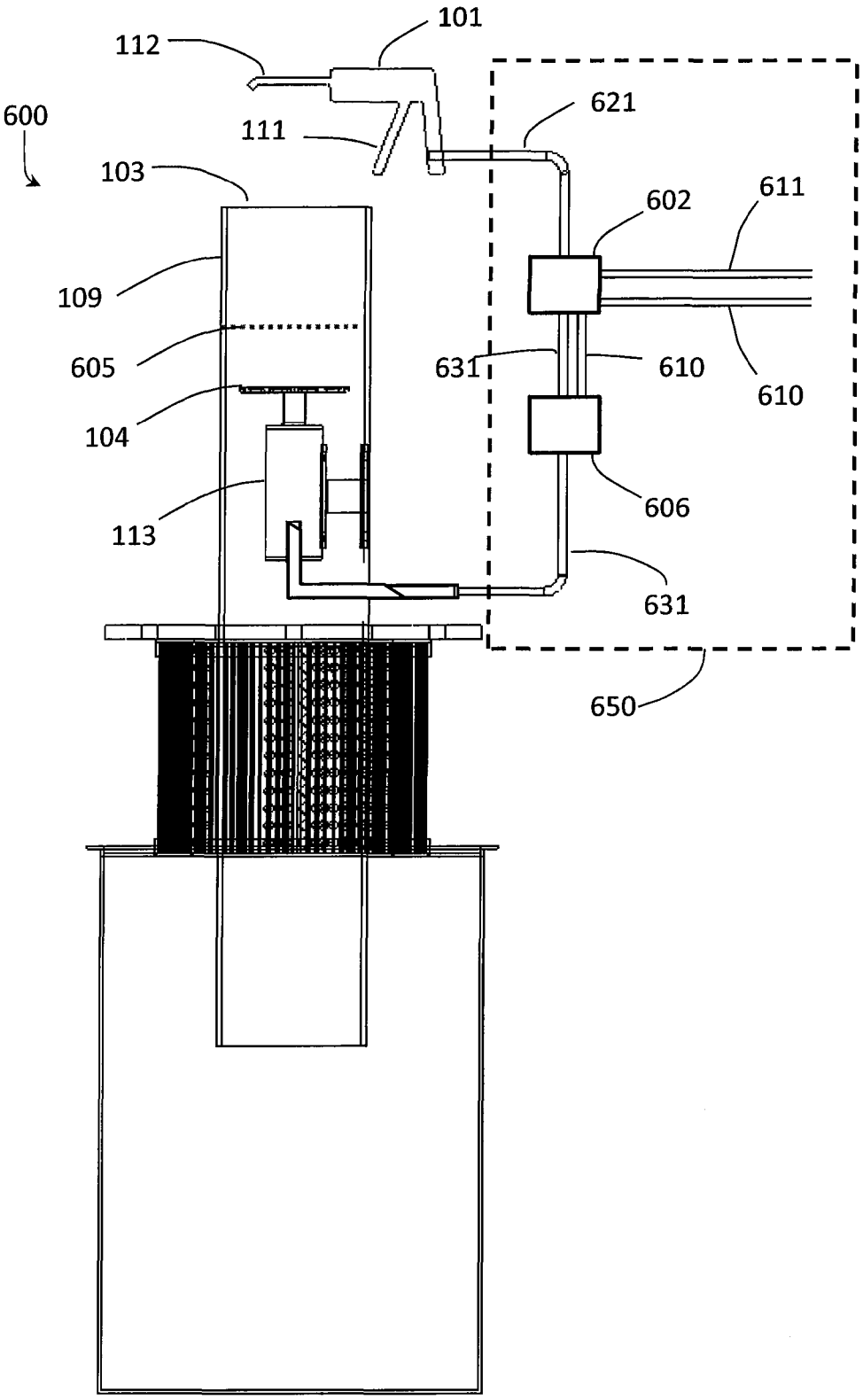
FIG. 6 illustrates an alternative embodiment of the exemplary gas cleaning system.

With reference to FIG. 6, there is illustrated an exemplary alternative embodiment 600 of the gas discharge system 100 wherein an electronic activation system is implemented instead of the valve assembly 200 that was utilized in the gas discharge system 100. Not all components of the gas discharge system 600 are enumerated for clarity and ease of illustration in FIG. 6. Those elements that are not enumerated operate as described herein with reference to the preceding figures. Those elements having the same identifying numerals as in the preceding figures operate similarly unless otherwise described hereinbelow. In the embodiment illustrated in FIG. 6, a pressurized gas tank (not shown) supplies pressurized gas to pressurized gas inlet 611 as described herein. Activation of the system is electric, using an electric differential pressure switch 602 to activate the gas discharge system 600. The gas discharger 101 operates as before by opening a gas channel therethrough when the trigger 111 is squeezed, which allows air to flow from the pressurized gas tank into the gas discharger tube 621 and through the gas discharger 101 and its nozzle 112. The differential pressure sensor switch 602 and a gas switch 606, such as a solenoid type of gas switch, are configured such that the differential pressure switch 602 detects the opening of the gas channel in the gas discharger 101 by sensing a differential pressure as between the gas discharger side of the differential pressure switch compared to the pressurized gas supply side. As the differential pressure increases, the differential pressure switch is triggered to electrically activate the gas solenoid switch 606 over electrical line 610. In response, the gas solenoid switch 606 opens an air passage therethrough which allows pressurized gas from the pressurized air tank to flow through air motor gas supply line 631 into the air motor 113 and, thereby, drive the fan 104 and initiate the suction through a top opening 103 of the vacuum tube 109. An electrical (power) line 610 provides electrical power to the differential pressure switch 602 and well as the air switch 606 and carries the activation signal from the differential pressure switch to the gas switch 606. A screen 605 may be placed inside the vacuum tube made from, for example, ¼ inch hardware cloth to capture components that may be unintentionally dropped into the vacuum tube 109. The air motor 113 may a be positioned at any one of a number of places in the vacuum tube or in the waste container so long as it is configured to draw air through the vacuum tube to generate a vacuum or suction at the top opening of the gas tube. The air motor may be encased in a PVC shroud to cut down on noise and make for easier mounting. The portion of the gas discharge system 600 within the dashed line box 650 includes a portion of the gas discharge system 600 that may be referred to herein as an exchangeable portion 650 of the gas discharge system 600. This portion 650 of the system may be replaced by another exchangeable portion of the systems described herein to construct various embodiments of gas discharge systems. The portion of gas discharge system 600 within the exchangeable portion 650 includes at least a portion of the gas discharge tube 621, at least a portion of the air motor gas supply tube 631, the differential pressure switch 602, the gas solenoid switch 606, at least a portion of electrical line 610, and at least a portion of the pressurized gas inlet 611.

Figure 7:
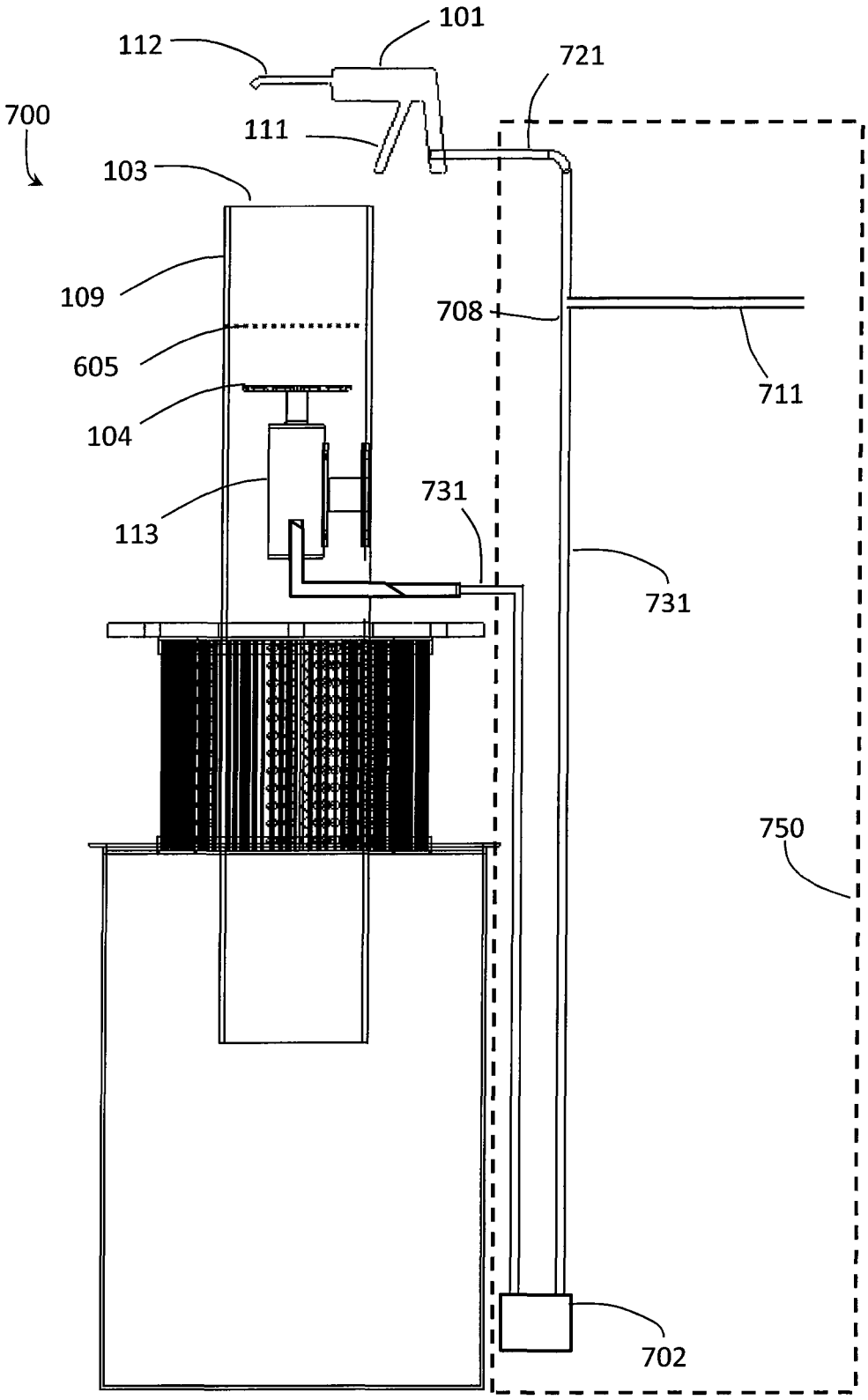
FIG. 7 illustrates another alternative embodiment of the exemplary gas cleaning system.

With reference to FIG. 7, there is illustrated an exemplary alternative embodiment 700 of the gas discharge system 100 wherein a gas switch 702, such as a solenoid type of gas switch, is used to activate the air motor 113 instead of the valve assembly 200 that was utilized in the gas discharge system 100. Not all components of the gas discharge system 700 are enumerated for clarity and ease of illustration in FIG. 7. Those elements that are not enumerated operate as described herein with reference to the preceding figures. Those elements having the same identifying numerals as in the preceding figures operate similarly unless otherwise described hereinbelow. In the embodiment illustrated in FIG. 7, a pressurized gas tank (not shown) supplies pressurized gas to pressurized gas inlet 711 as described herein. Activation of the gas discharger 101 operates as before wherein the trigger 111 operates to open a gas channel in the gas discharger 101 to allow pressurized air received at the pressurized gas inlet 711 to travel through the bidirectional T joint 708 through the gas discharger tube 721 and through the gas discharger 101 and its nozzle 112. An air switch 702, which may be embodied in a foot pedal, or other manually operable configuration, may be opened to allow the pressurized gas to flow from the pressurized gas inlet 711 through the bidirectional T-joint 708, through the opened gas switch 702, and through air motor tube 731 into the air motor 113, thereby activating the fan to generate suction in the vacuum tube as described herein. Thus, the gas discharger 101 and the air motor 113 may each be separately activated using the pressurized gas supply (tank). The portion of the gas discharge system 700 within the dashed line box 750 includes a portion of the gas discharge system 700 that may be referred to herein as an exchangeable portion 750 of the gas discharge system 700. This portion 750 of the system may be replaced by another exchangeable portion of the systems described herein to construct various embodiments of gas discharge systems. The portion of gas discharge system 700 within the exchangeable portion 750 includes at least a portion of the gas discharge tube 721, the gas switch 702, at least a portion of the air motor gas supply tube 731, and at least a portion of the pressurized gas inlet 711.

Figure 8:
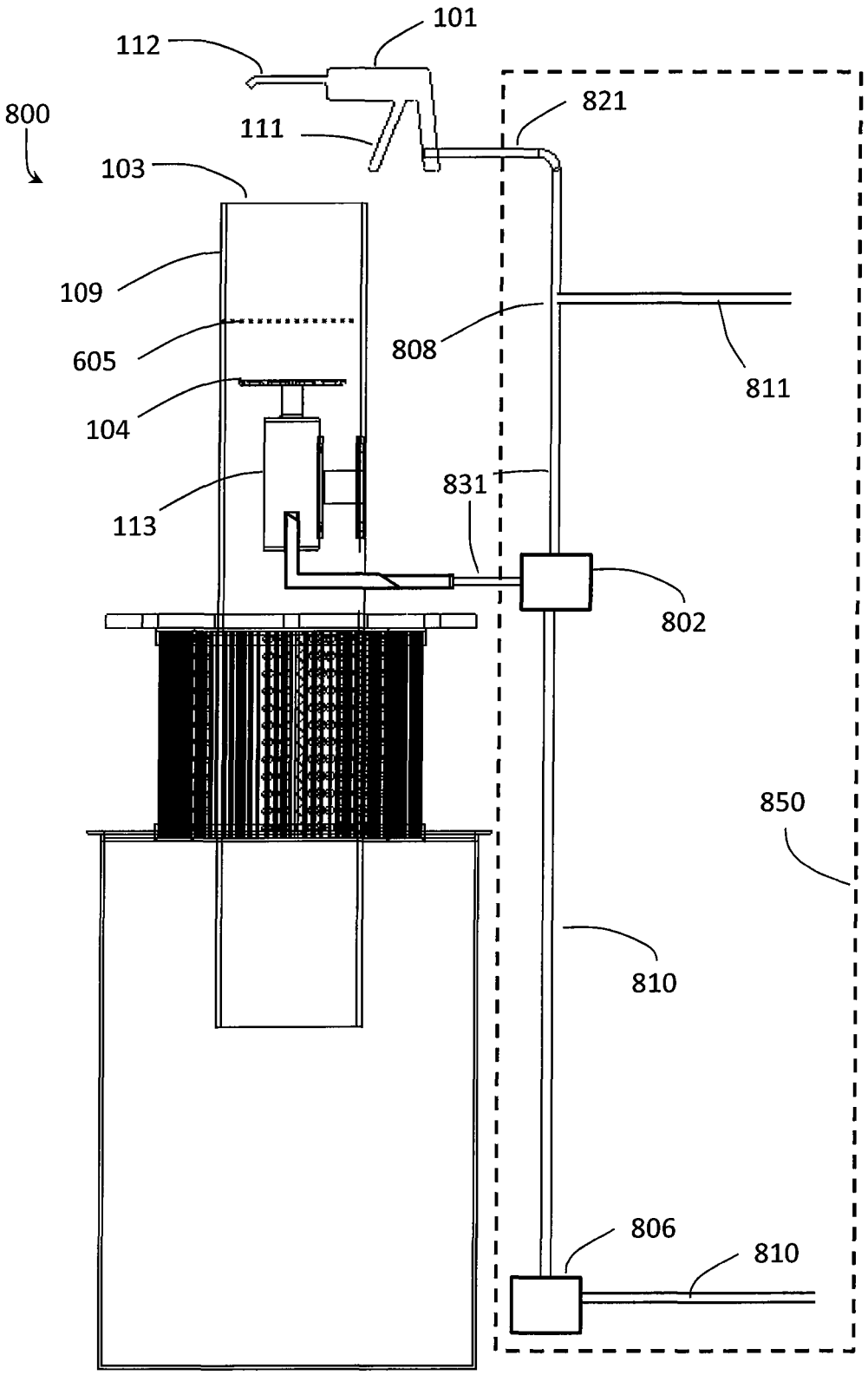
FIG. 8 illustrates yet another alternative embodiment of the exemplary gas cleaning system.

With reference to FIG. 8, there is illustrated an exemplary alternative embodiment 800 of the gas discharge system 100 wherein an electric activation system is implemented instead of the valve assembly 200 that was utilized in the gas discharge system 100. Not all components of the gas discharge system 800 are enumerated for clarity and ease of illustration in FIG. 8. Those elements that are not enumerated operate as described herein with reference to the preceding figures. Those elements having the same identifying numerals as in the preceding figures operate similarly unless otherwise described hereinbelow. In the embodiment illustrated in FIG. 8, a pressurized gas tank (not shown) supplies pressurized gas to pressurized gas inlet 811 as described herein. Activation of the gas discharger 101 operates as before wherein the trigger 111 operates to open a gas channel in the gas discharger 101 to allow pressurized gas received at the pressurized gas inlet 811 to travel through the bidirectional T joint 808 through the gas discharger tube 821 and through the gas discharger 101 and its nozzle 112. A gas switch 802, such as a solenoid type of gas switch, may be electrically activated over electrical line 810 to allow the pressurized gas to flow from the pressurized gas inlet 811 through the bidirectional T-joint 808, through air motor tube 831, through activated gas switch 802, and into the air motor 113, thereby activating the fan 104 to generate suction in the vacuum tube as described herein. An electric switch 806 may be embodied as a foot pedal switch or other manually operable switch, powered by electrical line 810 which serves to actuate gas switch 802. Thus, the gas discharger 101 and the air motor 113 may each be separately activated. The portion of the gas discharge system 800 within the dashed line box 850 includes a portion of the gas discharge system 800 that may be referred to herein as an exchangeable portion 850 of the gas discharge system 800. This portion 850 of the system may be replaced by another exchangeable portion of the systems described herein to construct various embodiments of gas discharge systems. The portion of gas discharge system 800 within the exchangeable portion 850 includes at least a portion of the gas discharge tube 821, at least a portion of the air motor gas supply tube 831, the gas switch 802, the electric switch 806, at least a portion of electrical line 810, and at least a portion of the pressurized gas inlet 811.

Figure 9:
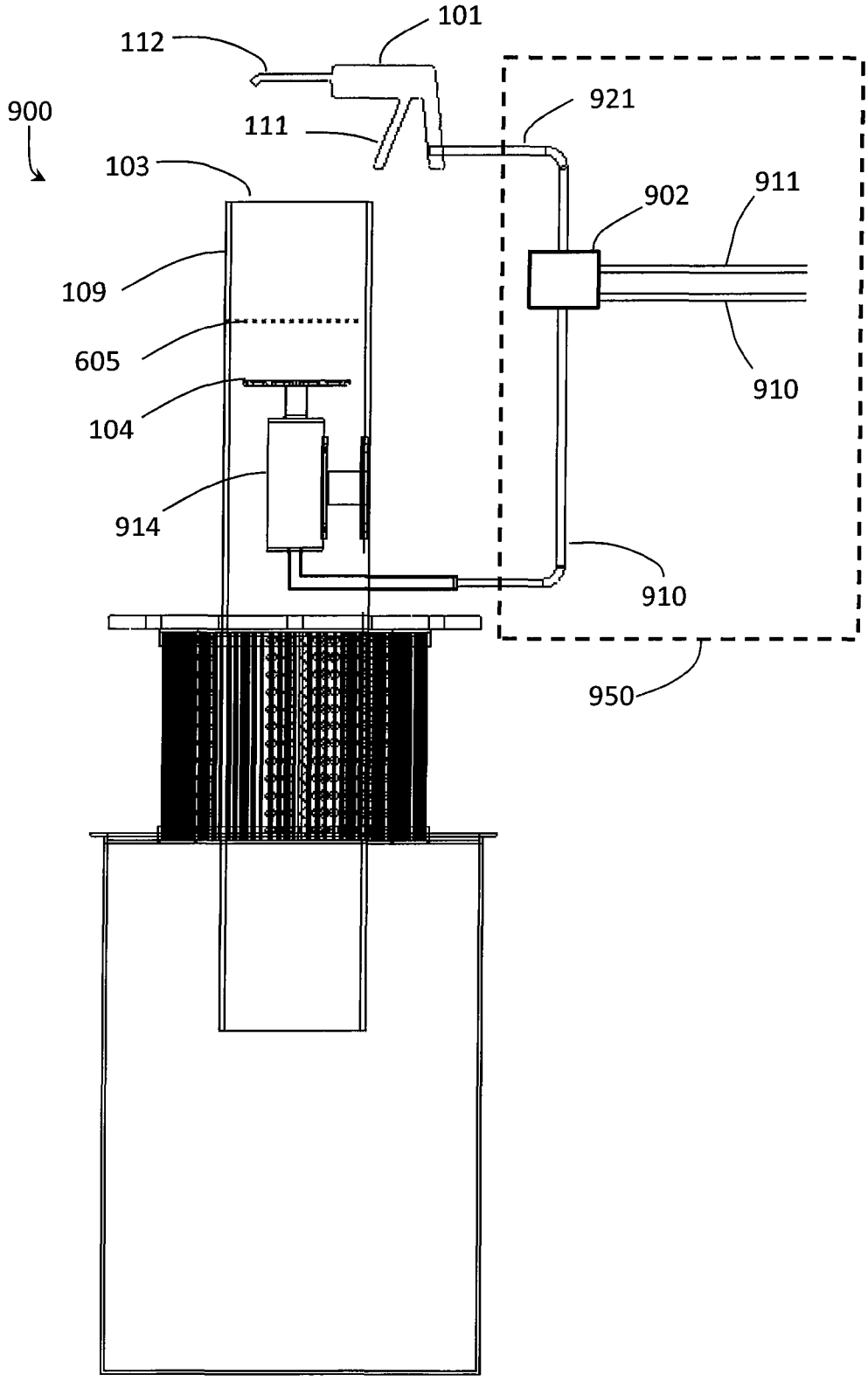
FIG. 9 illustrates yet another alternative embodiment of the exemplary gas cleaning system.

With reference to FIG. 9, there is illustrated an exemplary alternative embodiment 900 of the gas discharge system 100 wherein an electric activation system is implemented instead of the valve assembly 200 that was utilized in the gas discharge system 100. Not all components of the gas discharge system 900 are enumerated for clarity and ease of illustration in FIG. 9. Those elements that are not enumerated operate as described herein with reference to the preceding figures. Those elements having the same identifying numerals as in the preceding figures operate similarly unless otherwise described hereinbelow. In the embodiment illustrated in FIG. 9, a pressurized gas tank (not shown) supplies pressurized gas to pressurized gas inlet 911 as described herein. Activation of the system is electric, using an electric differential pressure switch 902 to activate the gas discharge system 900. The gas discharger 101 operates as before by opening a gas channel therethrough when the trigger 111 is squeezed, which allows air to flow from the pressurized gas tank into the pressurized gas inlet 911, through the activated differential pressure switch 902, and into the gas discharger tube 921 and through the gas discharger 101 and its nozzle 112. The differential pressure sensor switch 902 is configured so that the differential pressure switch 902 detects the opening of the gas channel in the gas discharger 101 by sensing a differential pressure as between the gas discharger side of the differential pressure switch 902 compared to the pressurized gas tank (supply) side. As the differential pressure increases, the differential pressure switch 902 is triggered to electrically activate electric motor 914 to begin rotating the fan 104 by connecting the electrical line 910 to the electric motor 914. An electrical line 910 provides electrical power to the differential pressure switch 902 as well as to the electric motor 914. The electric line 910 may also be configured to carry an activation signal from the differential pressure switch 902 to the electric motor 914 to activate the motor. Thus, the gas discharge system 900 may be activated by squeezing the gas discharger trigger 111 as in the discharge system embodiment 100. The portion of the gas discharge system 900 within the dashed line box 950 includes a portion of the gas discharge system 900 that may be referred to herein as an exchangeable portion 950 of the gas discharge system 900. This portion 950 of the system may be replaced by another exchangeable portion of the systems described herein to construct various embodiments of gas discharge systems. The portion of gas discharge system 900 within the exchangeable portion 950 includes at least a portion of the gas discharge tube 921, at least a portion of the electrical line 910, the differential pressure switch 902, and at least a portion of the pressurized gas inlet 911.

Figure 10:
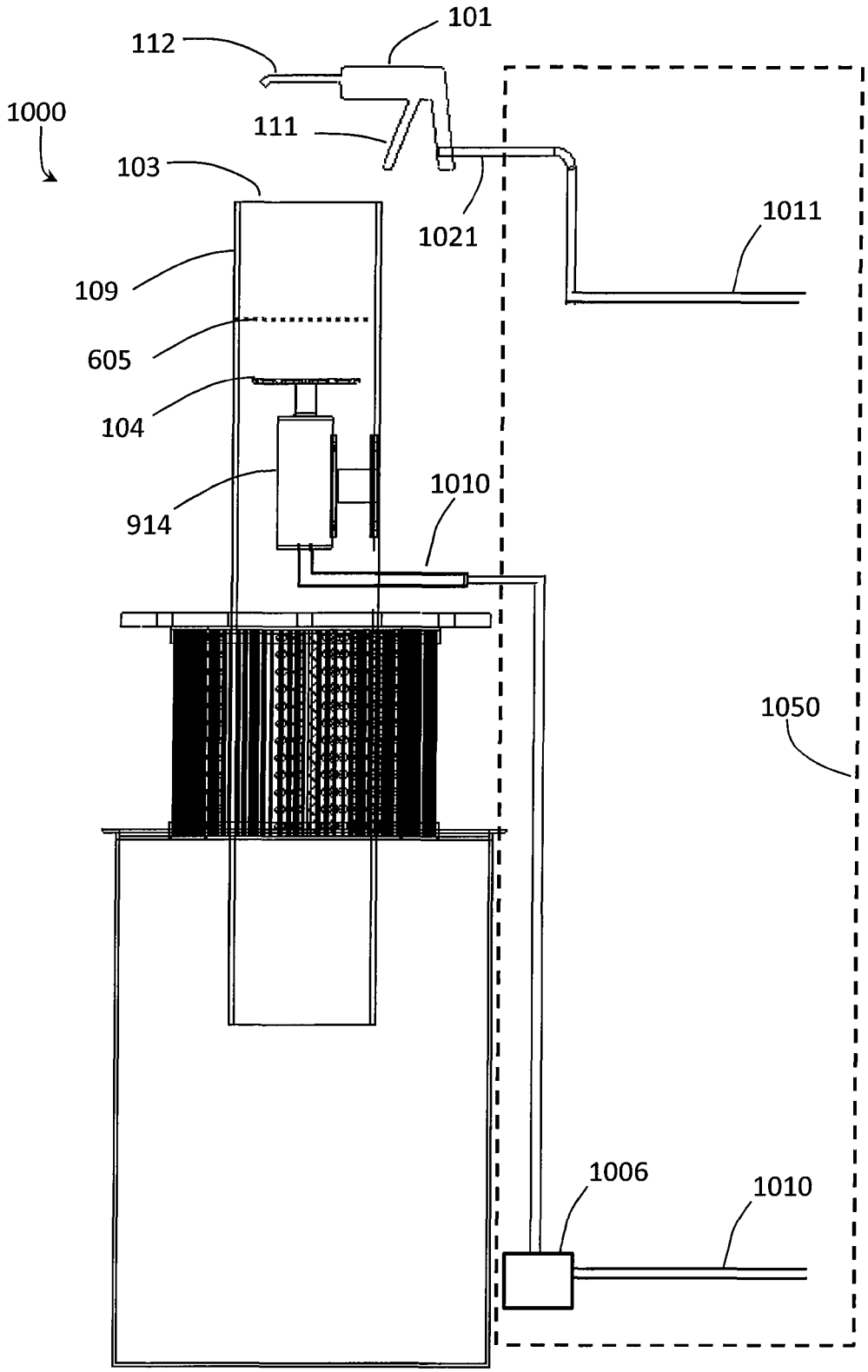
FIG. 10 illustrates yet another alternative embodiment of the exemplary gas cleaning system.

With reference to FIG. 10, there is illustrated an exemplary alternative embodiment 1000 of the gas discharge system 100 wherein an electric motor 914 is used to drive fan 104. Not all components of the gas discharge system 1000 are enumerated for clarity and ease of illustration in FIG. 10. Those elements that are not enumerated operate as described herein with reference to the preceding figures. Those elements having the same identifying numerals as in the preceding figures operate similarly unless otherwise described hereinbelow. An electrical line 1010 may be connected to the electric motor 914 via an electric switch 1006, for example, a foot pedal or other suitable switch, such as a manual switch, to activate and rotate the fan 104 and create suction at the top opening 103 of the gas tube 109. The gas discharger 101 is separately connected to a pressurized gas (tank) supply (not shown) via gas discharger tube 1011. The pressurized gas tank (not shown) supplies pressurized gas to the gas discharger tube 1011 as described herein. Activation of the gas discharger 101 operates as before wherein the trigger 111 operates to open a gas channel in the gas discharger 101 to allow pressurized air received at the gas discharger tube 1011 to travel through the gas discharger 101 and its nozzle 112. Thus, the gas discharger 101 and the electric motor 914 may each be separately activated. The portion of the gas discharge system 1000 within the dashed line box 1050 includes a portion of the gas discharge system 1000 that may be referred to herein as an exchangeable portion 1050 of the gas discharge system 1000. This portion 1050 of the system may be replaced by another exchangeable portion of the systems described herein to construct various embodiments of gas discharge systems. The portion of gas discharge system 1000 within the exchangeable portion 1050 includes at least a portion of the gas discharge tube 1021, electric switch 1006, at least a portion of electrical line 1010, and at least a portion of the pressurized gas inlet 1011.

Figure 11:
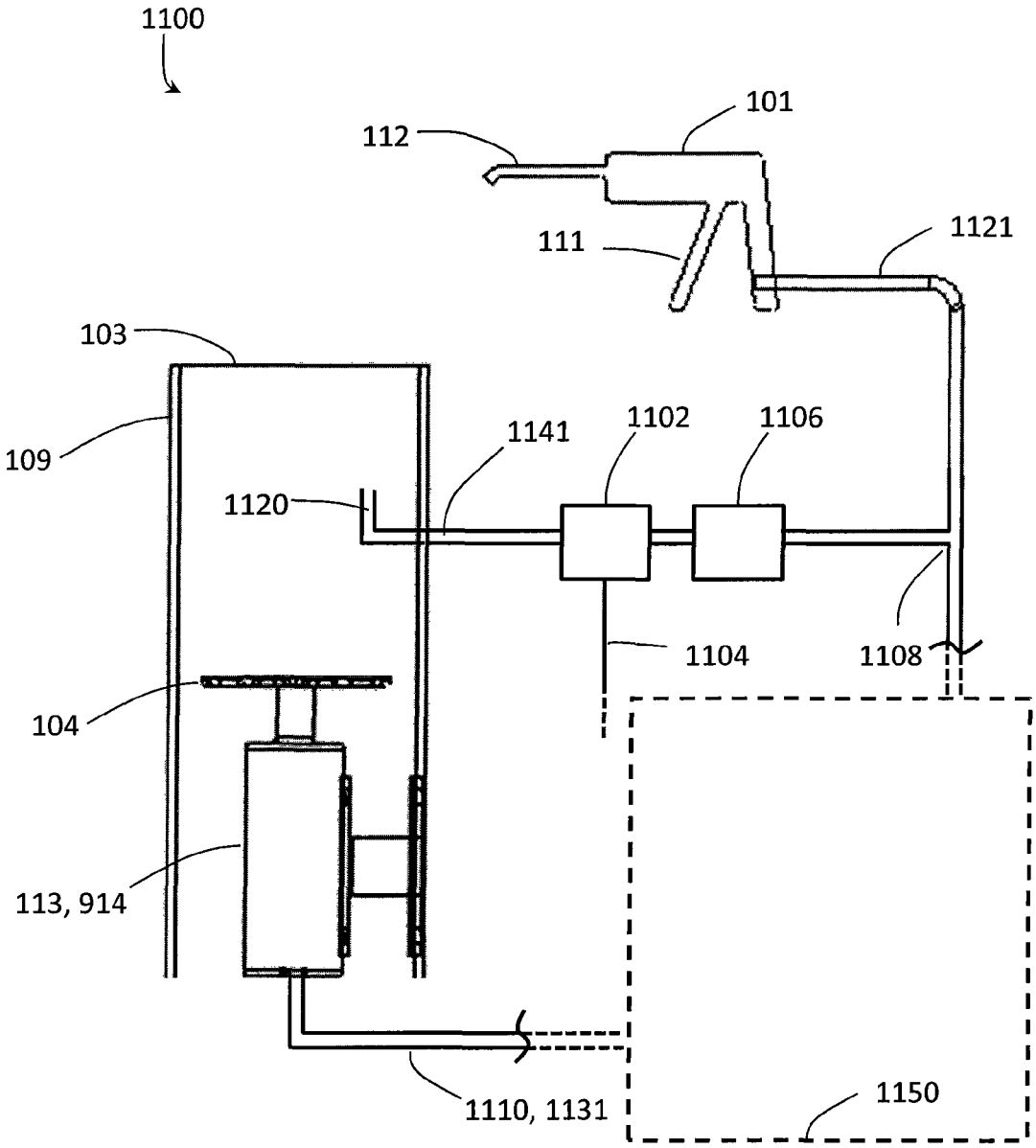
FIG. 11 illustrates yet another alternative embodiment of the exemplary gas cleaning system.

With reference to FIG. 11, there is illustrated exemplary alternative embodiments 1100 of the gas discharge system 100 wherein a second gas discharge nozzle 1120 is disposed in the vacuum tube 109. Not all components of the gas discharge systems 1100 are enumerated for clarity and ease of illustration in FIG. 11. Those elements that are not enumerated operate as described herein with reference to the preceding figures. Those elements having the same identifying numerals as in the preceding figures operate similarly unless otherwise described hereinbelow. In these embodiments, the second gas discharge nozzle 1120 receives pressurized gas diverted from the gas discharger tube 1121, using a T-joint 1108, into second gas discharger tube 1141. A pressure regulator 1106 and an air switch 1102 may be inserted into the second gas discharger tube 1141. The pressure regulator may be configured to allow a range of gas pressures to be discharged from the second gas pressure nozzle 1120 in an exemplary range of about 10-50 psi. The gas switch 1102 may be configured as a foot pedal gas switch or a manually activated gas switch to open a gas channel therein and allow the pressurized gas from the pressurized gas inlet 1111 to travel through the T-joint 1108, then through the second gas discharger tube 1141, through the pressure regulator 1106, through gas switch 1102, and be discharged from the second gas discharger nozzle 1120. The gas switch 1102, which may be a gas solenoid type of gas switch, may also be configured to be activatable remotely over a connected electric line 1104.

In the embodiments illustrated in FIG. 11, an air motor 113 or an electric motor 914 may be used to drive the fan 104 to generate suction at the top opening 103 of the vacuum tube 109. Accordingly, a corresponding electrical line 1110 or a gas supply tube 1131 may be connected to the motor 113, 914 as described herein. The various embodiments disclosed herein of the gas discharge systems, 100, 600, 700, 800, 900, and 1000 may be implemented in the gas discharge systems 1100 by incorporating those exchangeable portions 150, 650, 750, 850, 950, and 1050 of the gas discharge systems, 100, 600, 700, 800, 900, and 1000, respectively, into gas discharge system 1100 at the position represented by dashed line box 1150. This will provide pressurized air to the gas discharger tube 1121 and pressurized air or electric power to the motor 113, 914, over air motor tube 1131 or electric line 1110, respectively, for operation as described herein.

Advantages provided by the gas discharge system as described and illustrated herein include a portable cleaning system entirely powered by a pressurized gas supply, which is useful for cleaning objects that may be damaged by liquid based cleaners, or where liquid based cleaning is unnecessary, inconvenient, or time inefficient. The gas discharge system becomes activated by squeezing the trigger of the gas discharger and is immediately usable and productive. The combination of a pressurized gas stream and a vacuum source maintains a work space that is mostly free of debris, dust, and other contaminants. In a typical application, a user can hold in one hand an object, such as a manufactured part having debris and/or oil clinging thereto, above the vacuum tube opening while simultaneously holding the gas discharger in the other hand. Because both the vacuum and the pressurized gas stream of the gas discharge system are activated and deactivated solely by the user squeezing and releasing the trigger in one hand, cleaning of various objects can be easily performed.

This written description uses examples to disclose the invention, including the best mode, and also to enable any person skilled in the art to practice the invention, including making and using any devices or systems and performing any incorporated methods. It will be understood that, although specific embodiments of the invention have been described herein for purposes of illustration and explained in detail with particular reference to certain preferred embodiments thereof, numerous modifications and all sorts of variations may be made and can be effected within the spirit of the invention and without departing from the scope of the invention. Accordingly, the scope of protection of this invention is limited only by the following claims and their equivalents.

PARTS LIST

100 gas discharge system
101 gas discharger
102 gas discharger tube
103 vacuum tube top opening
104 fan
106 pressurized gas inlet
107 gas filter
108 waste container
109 vacuum tube
110 air motor gas supply tube
111 trigger
112 nozzle
113 air motor
114 support plate
115 vacuum tube bottom opening
116 waste container bottom surface
117 air motor mount
118 waste container cover
119 waste container height
120 filter height
121 vacuum tube height
150 exchangeable portion
200 valve assembly
201 piston rod
202 piston rod bevel
203 pressurized inlet tube end
204 gas pathway
205 gas pathway
206 gas pathway
207 gas pathway
208 plug
209 o-ring
210 piston neck
211 piston perimeter recess
212 bleed hole
213 piston
214 piston top surface
215 piston chamber bottom surface
216 piston rod guide tube
217 piston chamber
218 valve interior gas channel
219 pressurized gas inlet
220 air motor outlet
221 plug depression
222 gas outlet
223 valve body
224 bushing
225 o-ring
226 piston bottom surface
227 valve cap
228 screw hole
305 inside surface of piston chamber
600 gas discharge system

602 differential pressure switch
605 screen
606 gas solenoid switch
610 electrical line
611 pressurized gas inlet
621 gas discharger supply tube
631 air motor supply tube
650 exchangeable portion
700 gas discharge system
702 gas switch
708 T joint
711 pressurized gas inlet
721 gas discharger supply tube
731 air motor supply tube
750 exchangeable portion
800 gas discharge system
802 electric gas switch
806 electric switch
808 T-joint
810 electrical line
811 pressurized gas inlet
821 gas discharger supply tube
831 air motor supply tube
850 exchangeable portion
900 gas discharge system
902 differential pressure switch
910 electrical line
911 pressurized gas inlet
914 electric motor
921 gas discharger supply tube
950 exchangeable portion
1000 gas discharge system
1006 electric switch
1010 electrical line
1011 pressurized gas inlet
1021 gas discharge tube
1050 exchangeable portion
1100 gas discharge system
1102 gas switch
1104 gas switch control line
1106 pressure regulator
1108 T-joint
1110 electrical line
1120 pressurized gas nozzle
1121 gas discharger supply tube
1131 air motor supply tube
1141 second gas nozzle supply tube
1150 exchangeable portion

What is claimed is:

1. A system comprising:

a gas discharger comprising a gas channel, the gas channel configured to be opened and closed;

a vacuum source;

a gas inlet, the gas inlet configured to be connected to a source of pressurized gas;

the gas discharger and the vacuum source each configured to be in communication with the gas inlet and to be simultaneously operable by using the pressurized gas;

a gas switch connected between the vacuum source and the gas inlet; and a differential pressure sensor connected to the gas discharger and to the gas inlet, the differential pressure sensor configured to electrically activate the gas switch in response to sensing that the gas channel in the gas discharger is opened.

2. The system of claim 1, wherein the vacuum source comprises a fan configured to be rotated by an air motor for generating suction, the air motor configured to be driven by the pressurized gas.

3. The system of claim 2, wherein the gas discharger comprises a valve configured to be manually actuated for opening and closing the gas channel, the opened gas channel for discharging the pressurized gas through the gas discharger.

4. The system of claim 3, further comprising:

a gas discharger supply tube for providing gas traveling through the gas inlet to the gas discharger; and an air motor gas supply tube for providing gas traveling through the gas inlet to the air motor.

5. A system comprising:

a gas discharger comprising a gas channel, the gas channel configured to be opened and closed;

a gas inlet in fluid communication with the gas discharger, the gas inlet configured to be connected to a source of pressurized gas;

a vacuum source; and a differential pressure sensor connected to the gas discharger and to the gas inlet, the differential pressure sensor configured to electrically activate the vacuum source in response to sensing that the gas channel in the gas discharger is opened.

6. The system of claim 5, wherein the vacuum source comprises a fan configured to be rotated by an electric motor when the vacuum source is electrically activated.

7. The system of claim 6, wherein the gas discharger comprises a valve configured to be manually actuated for opening and closing the gas channel, the opened gas channel for discharging the pressurized gas through the gas discharger.

8. The system of claim 7, further comprising:

a gas discharger supply tube for providing gas traveling through the gas inlet to the gas discharger.

9. A system comprising:

a gas discharger comprising a gas channel, the gas channel configured to be opened and closed;

a gas inlet, the gas inlet in fluid communication with the gas channel, and configured to be connected to a source of pressurized gas;

a vacuum source, the vacuum source configured to be electrically activated, the vacuum source configured to generate a suction in a vacuum tube; and a waste container attached proximate a first end of the vacuum tube such that the suction draws air through a second end of the vacuum tube into the waste container.

10. The system of claim 9, wherein the vacuum source comprises a fan configured to be rotated by an electric motor for activating the vacuum source.

11. The system of claim 10, wherein the gas discharger comprises a valve configured to be manually actuated for opening and closing the gas channel, the opened gas channel for discharging the pressurized gas through the gas discharger.

* * * * *